106-18.35 SR
2/24/81 XR 4,252,665

United States Patent [19]
Casey et al.

[11] 4,252,665
[45] Feb. 24, 1981

[54] DISINFECTANT CLEANING COMPOSITIONS

[75] Inventors: Edward A. Casey, Crestwood; Robert P. Langguth, Overland; Kathie J. Tryson, University City, all of Mo.

[73] Assignee: Monsanto Company, St. Louis, Mo.

[21] Appl. No.: 48,219

[22] Filed: Jun. 13, 1979

Related U.S. Application Data

[63] Continuation-in-part of Ser. No. 972,831, Dec. 26, 1978, abandoned.

[51] Int. Cl.[3] ..... C11D 3/48
[52] U.S. Cl. ..... 252/106; 252/174.23; 252/174.24; 106/18.33; 106/18.34; 106/18.35
[58] Field of Search ..... 252/106, 174.23, 174.24; 106/18.33, 18.34, 18.35

[56] References Cited

U.S. PATENT DOCUMENTS

| | | | |
|---|---|---|---|
| 1,981,792 | 11/1934 | Orelup | 260/99.12 |
| 3,538,217 | 11/1970 | Dewar et al. | 252/106 |
| 3,824,190 | 7/1974 | Winicou et al. | 252/106 |
| 3,975,280 | 8/1976 | Hachmann | 252/106 |
| 4,116,852 | 9/1978 | Bailey et al. | 252/135 |
| 4,122,085 | 10/1978 | Douglas | 252/106 |
| 4,124,520 | 11/1978 | Schwalley | 252/106 |

FOREIGN PATENT DOCUMENTS

| | | |
|---|---|---|
| 623617 | 11/1961 | Canada . |
| 870994 | 6/1961 | United Kingdom . |

*Primary Examiner*—Mayer Weinblatt
*Attorney, Agent, or Firm*—S. M. Tarter; W. H. Duffey; R. C. Griesbauer

[57] ABSTRACT

Aqueous compositions useful as disinfectant hard-surface cleaners comprise:

(a) from about 0.03 percent to about 20 percent by weight orthobenzyl-para-chlorophenol;
(b) from about 1.0 to about 2.5 parts by weight, per part by weight of Component (a), of an alkali metal salt of an alkyl naphthalene sulfonic acid or mixtures thereof;
(c) from 0 to about 1.5 parts by weight, per part by weight of Component (a), of a surfactant which is different from Component (b) selected from the group consisting of
  (1) anionic surfactants selected from the group consisting of water soluble organic sulfonates and sulfates;
  (2) sulfobetaine surfactants; and
  (3) mixtures thereof; and
(d) from about 0.02 to about 0.05 parts by weight, per combined parts by weight of Components (b) and (c), of a detergency boosting acrylic copolymer.

8 Claims, No Drawings

DISINFECTANT CLEANING COMPOSITIONS

CROSS REFERENCE TO RELATED APPLICATIONS

This is a continuation-in-part of copending application Ser. No. 972,831, filed Dec. 26, 1978 and now abandoned.

BACKGROUND OF THE INVENTION

This invention relates to disinfectant cleaning compositions useful as hard-surface and general purpose household cleaners. More particularly, this invention relates to disinfectant cleaning compositions which contain a phenolic germicide.

DESCRIPTION OF THE PRIOR ART

It is well known that phenols and especially chlorinated phenols are effective germicides. Phenolic germicides are commonly employed in commercial disinfectant products which have become an important means of fighting disease-causing organisms. Such disinfectant products are typically employed in hospitals, schools, homes and public and private facilities to eliminate bacteria found on hard surfaces. A well known commercially available phenolic germicide is ortho-benzyl-para-chlorophenol which is sold by Monsanto Company under the trademark SANTOPHEN®1 germicide.

In attempting to formulate cleaning compositions containing phenolic germicides, various problems are encountered due to the nature of the phenolic material. For example, the phenolic materials commonly employed have limited solubility in water and therefore it is usually necessary to employ a solubilizing agent with such phenolic compounds. Furthermore, it is known that the activity or stability of phenolic germicides can be adversely affected by the presence of other ingredients such as inorganic salts, organic detergents and organic solubilizers. Thus it can be appreciated that a difficult formulation problem is presented when attempting to formulate cleaning compositions employing phenolic germicides.

A particular class of surface active agents useful as a solubilizer and stabilizer for phenolic bacteriocides is disclosed in U.S. Pat. No. 3,538,217 issued to N. E. Dewar et al on Nov. 3, 1970. The surface active agents disclosed therein are sulfated ethoxylated primary or secondary alcohols. The compositions disclosed therein are aqueous compositions which contain from about 0.05 to about 1.0 part by weight, on an anhydrous basis, of the sulfated ethoxylated surface active agent for each part by weight of the phenolic component, calculated as the free phenol. It is stated therein that such compositions are highly effective aqueous alkaline phenolic antimicrobial compositions, stable to precipitation and/or deactivation of the phenol compounds.

In U.S. Pat. No. 3,824,190 issued to M. W. Winicov et al, there are disclosed detergent disinfectant compositions which employ a mixture of orthophenylphenol and high activity and/or intermediate activity phenols to provide particularly effective disinfectant action. The compositions disclosed therein also contain an anionic detergent. It is further stated that said compositions can be formulated to include other conventionally employed components such as solvents, builders and the like, as is well known to those skilled in the art.

In the formulation of disinfectant cleaning compositions, in addition to the phenolic component and previously-mentioned solubilizer, other ingredients such as surfactants, builders, chelating agents, solvents, perfumes and the like may be included. A combination of such materials is usually necessary to achieve the various properties for the composition which are deemed important for commercial acceptance of the composition. Criteria deemed important for such compositions include cleaning performance, germicidal effectiveness, temperature stability, solution clarity, foaming properties, odor and low skin irritation. It is typical, for example, to include in a disinfectant composition containing a phenolic and a surfactant, a phosphate buffer which boosts the cleaning capability of the surfactant. It is understandable, however, that the previously-mentioned formulation difficulties increase as additional ingredients are included in phenolic disinfectant compositions.

Although phosphate builders have been successfully employed in phenolic disinfectant compositions to achieve compositions with desirable cleaning performance and other properties, it has been particularly difficult to achieve comparable compositions which are phosphate-free. Furthermore, non-phosphate containing disinfectant cleaning compositions are of interest, particularly in ares where the use of phosphates in detergent formulations is restricted.

Accordingly, it is an object of this invention to provide novel non-phosphate containing compositions which exhibit effective cleaning performance and other desirable properties for hard-surface disinfectant cleaning compositions.

SUMMARY OF THE INVENTION

In accordance with this invention there are provided aqueous compositions comprising (a) from about 0.03 percent to about 20 percent by weight orthobenzyl-para-chlorophenol;

(b) from about 1.0 to about 2.5 parts by weight, per part by weight of Component (a), of an alkali metal salt of an alkyl naphthalene sulfonic acid or mixtures thereof;

(c) from 0 to about 1.5 parts by weight, per part by weight of Component (a), of a surfactant which is different from Component (b), selected from the group consisting of
  (1) anionic surfactants selected from the group consisting of water soluble organic sulfonates and sulfates;
  (2) sulfobetaine surfactants; and
  (3) mixtures thereof; and (d) from about 0.02 to about 0.05 parts by weight, per combined parts by weight of Components (b) and (c), of a detergency boosting acrylic copolymer.

DETAILED DESCRIPTION OF THE INVENTION

The compositions of the present invention employ ortho-benzyl-para-chlorophenol as a germicide. The use of this phenolic compound is disinfectant compositions is well known in the art. For example, it is listed as a preferred phenolic compound in the compositions disclosed in the aforementioned U.S. Pat. No. 3,538,217. Ortho-benzyl-para-chlorophenol is commercially available from Monsanto Company under the trademark SANTOPHEN®1 germicide.

The amount of ortho-benzyl-para-chlorophenol employed in the aqueous compositions of the present invention can vary, depending upon the desired strength of the composition. A concentrated composition which would be diluted considerably for end-use application can contain as much as about 20 percent by weight ortho-benzyl-para-chlorophenol. Even higher levels may be possible, but it would be expected that at much higher levels problems would be encountered in solubilizing the essential components of the compositions of this invention. Disinfectant cleaning compositions are often sold in a concentrated form which is diluted, for example, with from about 25 to about 300 parts by weight of water per part by weight of the concentrated composition, for end-use applications. Aqueous compositions of the present invention at end-use strength can contain levels of ortho-benzyl-para-chlorophenol as low as about 0.03 percent by weight. It is desirable to have at least 0.03 percent by weight ortho-benzyl-para-chlorophenol to assure adequate germicidal effectiveness. In preferred compositions of the present invention the ortho-benzyl-para-chlorophenol is present at from about 0.05 percent to about 5 percent by weight.

The compositions of the present invention also contain an alkyl naphthalene sulfonate, or mixtures thereof, designated as Component (b) herein. Various alkyl naphthalene sulfonates which are well known in the art as being useful as surfactants may be employed. Methods for preparing such compounds are also well known to those skilled in the art. Various alkyl naphthalene sulfonates are listed in the 1978 North American Edition of "McCutcheon's Detergents and Emulsifiers", published by The Manufacturing Confectioner Publishing Co.

It is to be understood that the term "alkyl" as it is used in the description of the naphthalene sulfonate and, unless otherwise specified, as it is used elsewhere herein, includes both straight chain and branched radicals, but not cyclic radicals.

Alkyl naphthalene sulfonates which are useful as surfactants typically contain from 1 to about 3 alkyl groups. Generally preferred alkyl groups are the lower alkyls, i.e., alkyl groups containing from 1 to about 4 carbon atoms. It is preferred that the total number of carbon atoms for all of the alkyl groups in the alkyl naphthalene sulfonate be a maximum of about 9, more preferably a maximum of about 6.

The alkyl naphthalene sulfonate is present in the compositions of the present invention as an alkali metal salt. Alkali metals are well known to those skilled in the art to be metals in Group Ia of the Periodic Table of the Elements. The sodium salt is a preferred alkali metal salt. Those skilled in the art would recognize that alkyl naphthalene sulfonic acid may be employed in preparing the compositions of the present invention, which acid would convert to a salt when the desired alkaline pH of the composition is achieved.

The amount of Component (b) in the compositions of the present invention varies widely from small amounts in end-use strength compositions to much larger amounts in concentrated compositions. In general, Component (b) will be present at from about 1 to about 2.5 parts by weight, per part by weight of the ortho-benzyl-para-chlorophenol present in the composition. At levels much less than the lower stated level, the amount of Component (b) would not be sufficient to solubilize the ortho-benzyl-para-chlorophenol. At levels much higher than the upper stated level, it was found that cleaning performance of the composition is adversely affected. A preferred range is from about 1.2 to about 2.2 parts by weight per part by weight of ortho-benzyl-para-chlorophenol.

The compositions of the present invention optionally contain a surfactant, designated as Component (c) herein, which is different from Component (b). This surfactant is selected from the group consisting of (1) anionic surfactants which are water soluble organic sulfates or sulfonates; (2) sulfobetaine surfactants; and (3) mixtures thereof.

Anionic surfactants which are water soluble organic sulfates or sulfonates are well known in the art. These surfactants can be broadly described as the water soluble salts, particularly the alkali metal salts, of organic sulfuric acid reaction products having in their molecular structure an alkyl radical containing from about 8 to about 22 carbon atoms and a radical selected from the group consisting of sulfonic acid and sulfuric acid ester radicals. (Included in the term alkyl is the alkyl portion of higher acyl radicals.) Examples of these anionic surfactants which are preferred in the present invention are the sodium or potassium alkyl sulfates, especially those obtained by sulfating the higher alcohols ($C_8$–$C_{18}$ carbon atoms) produced by reducing the glycerides of tallow or coconut oil; sodium or potassium alkylbenzene sulfonates, in which the alkyl group can be a straight or branched chain and contains from about 9 to about 15 carbon atoms, preferably about 11–13 carbons; alcohol ether sulfates which are sodium or potassium salts of sulfuric acid esters of the reaction product of one mole of a higher fatty alcohol (e.g., tallow or coconut oil alcohols) and about 1 to 6 moles of ethylene oxide; sodium or potassium alkyl phenol ethylene oxide ether sulfates with 1 to 10 units of ethylene oxide per molecule and wherein the alkyl radicals contain from 8 to 12 carbon atoms; and sodium and potassium salts of $SO_3$—sulfonated $C_{10}$-$C_{24}$ $\alpha$-olefins. Still another example of preferred anionic surfactants are the sulfated products of the condensation reaction product of fatty acids, preferably having about 12–14 carbon atoms, with a lower alkyl (e.g., $C_1$–$C_5$) alcohol amine, e.g., monoethanolamine or diethanolamine. These latter-described sulfated products are disclosed in U.S. Pat. No. 1,981,792 issued Nov. 20, 1934.

Other examples of anionic surfactants which can be employed as Component (c) are sodium alkyl glyceryl ether sulfonates, especially those ethers of the higher alcohols derived from tallow and coconut oil; sodium coconut oil fatty acid monoglyceride sulfates and sulfonates; the reaction product of fatty acids esterified with isethionic acid and neutralized with sodium hydroxide where, for example, the fatty acids are derived from coconut oil; and sodium or potassium salts of fatty acid amide of a methyl tauride in which the fatty acids, for example, are derived from coconut oil.

A detailed description of typical anionic water soluble organic sulfonates and sulfate is found in U.S. Pat. No. 4,116,852 issued to J. Bailey et al on Sept. 26, 1978, which patent is herein incorporated by reference.

Particularly preferred anionic surfactants are the $\alpha$-olefin sulfonates, typically containing from 10 to 24 carbon atoms.

Sulfobetaine surfactants may be employed as Component (c) in the compositions of the present invention. The term "sulfobetaine surfactant" as it is used herein means a material selected from the group of compounds represented by the formula:

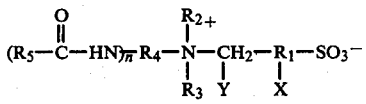

wherein:

$R_1$ is an alkylene radical having from 1 to about 3 carbon atoms,

Y is hydrogen or methyl,

X is hydrogen, methyl or hydroxy, $R_2$ and $R_3$ are each selected from methyl, ethyl and hydroxyethyl radicals, n=0 or 1, when n=0, $R_4$ is an alkyl radical having from about 10 to about 18 carbon atoms, when n=1, $R_4$ is an alkylene radical having from about 2 to about 6 carbon atoms, $R_5$ is an alkyl radical having from about 10 to about 18 carbon atoms;

and mixtures thereof.

It is to be understood that the term "alkylene" as it is used herein, encompasses both polymethylene radicals and other divalent saturated aliphatic radicals and thus there may be branching in the linkage provided by the alkylene radical.

The sulfobetaines which are employed in the compositions of the present invention are known in the art and have been described as zwitterionic surfactants. The preparation of such compounds is described, for example, by G. W. Fernley in the JOURNAL OF AMERICAN OIL CHEMISTS SOCIETY, January 1978 (Vol. 55), pages 98–103, and by R. Ernst in U.S. Pat. No. 3,280,179 issued Oct. 18, 1966, which patent is incorporated herein by reference.

In preferred sulfobetaine surfactants, $R_2$ and $R_3$ in the above structure are methyl. It is also preferred that $R_1$ be ethylene.

One type of sulfobetaine surfactant which can be employed has the above structure wherein n equals 0 and $R_4$ is an alkyl radical having from about 10 to about 18 carbon atoms, preferably a straight chain alkyl radical. For these sulfobetaine surfactants, a convenient source of the $R_4$ component is tallow fatty alcohol which consists of a mixture of various chain lengths, with a typical composition being approximately 66 percent $C_{18}$, 30 percent $C_{16}$ and 4 percent $C_{14}$ and others. Another convenient source is the middle cut of distilled coconut fatty alcohol, which also consists of a mixture of various chain lengths, with a typical composition being approximately 66 percent $C_{12}$, 23 percent $C_{14}$, 9 percent $C_{16}$ and 2 percent $C_{10}$.

Specific sulfobetaine surfactants of the above structure wherein n equals 0 are set forth in U.S. Pat. No. 3,539,521 issued on Nov. 10, 1970 to A. O. Snoddy et al, which patent is herein incorporated by reference.

Another type of sulfobetaine surfactant which can be employed has the above structure wherein n equals 1 and $R_4$ is an alkylene radical having from about 2 to about 6 carbon atoms, preferably from about 2 to about 4 carbon atoms. In these sulfobetaines wherein n equals 1, $R_5$ is an alkyl radical having from about 10 to about 18 carbon atoms. It is preferred that $R_5$ be straight chain. As previously discussed, convenient sources of alkyl radicals having from about 10 to about 18 carbon atoms are tallow fatty alcohol and coconut fatty alcohol.

Specific sulfobetaine surfactants of the above structure wherein n equals 1 are set forth in the previously-mentioned U.S. Pat. No. 3,280,179.

Particularly preferred sulfobetaine surfactants for use in compositions of the present invention are 3-(N,N-dimethyl-N-acylamidopropylammonio)-2-hydroxypropane-1-sulfonates wherein the acyl group is derived from tallow fatty alcohol or coconut fatty alcohol, with coconut fatty alcohol preferred. It would be recognized by those skilled in the art that in the normal preparation of these derivatives of tallow or coconut fatty alcohols, a mixture of sulfobetaines with varying carbon chain lengths for the acyl groups would result. As previously discussed, these fatty alcohols contain for the most part carbon chain lengths which will provide acyl groups with the desired number of carbon atoms, that is from about 11 to about 19 carbon atoms. Thus, these mixtures obtained from tallow or coconut fatty alcohols are useful in providing the sulfobetaine surfactant in the compositions of the present invention. A material of this type particularly preferred for use in the composition of the present invention is N-cocoamidopropyl-N,N-dimethyl-N-2-hydroxypropyl sulfobetaine, an example of which is Lonzaine CS, commercially available from Lonza, Inc., Fair Lawn, New Jersey.

Component (c) may be a single compound or a mixture of compounds. A mixture may consist of compounds of one of the above-described types, e.g., the organic sulfonates and sulfates, or of different types. Thus, for example, it is possible to have a mixture of organic sulfonates and/or sulfates and sulfobetaines.

The amont of Component (c) in the compositions of the present invention is generally from 0 to about 1.5 parts by weight, per part by weight of the ortho-benzyl-para-chlorophenol in the composition. Although an effective disinfectant cleaning composition can be obtained without Component (c), and it is therefore an optional component, it is preferred for enhanced cleaning performance and improved foaming properties to include Component (c) at from about 0.3 to about 1.5 parts by weight, on the previously-stated basis. Levels higher than the 1.5 parts by weight may be possible, but in general would not be economically justified and, in fact, with certain materials it was found that at levels much higher the cleaning performance is adversely affected.

The compositions of the present invention additionally contain a detergency boosting acrylic copolymer designated Component (d) herein. The term "detergency boosting" as it is used in the specification and claims means that the acrylic copolymer enhances the cleaning performance of a composition containing the just-described Components (a), (b) and (c) when added thereto. A typical test for evaluating cleaning performance of compositions of this type is described in Example II hereinafter. Surprisingly, acrylic copolymers which were employed were found to provide enhanced detergency when added at very low levels to compositions containing materials representing Components (a), (b) and (c) of the compositions of the present invention.

Various acrylic copolymers may be employed so long as they boost the detergency of the composition without significantly adversely affecting other desired properties of a disinfectant cleaning composition. In general, the acrylic copolymers which can be employed in the compositions of the present invention can be described as copolymers containing 25 to 70 percent by weight of methacrylic acid units and at least 10 percent by weight of units representing an acrylic acid ester of a lower alcohol having from 1 to 4 carbon atoms. The lower acrylate or a mixture thereof may make up the entire balance of the copolymer (i.e., other than methacrylic acid) or a portion of the balance (up to 40 percent by weight of the copolymer) can be derived from one or more neutral monoethylenically unsaturated copolymerizable monomers, methylmethacrylate being preferred. These copolymers and the preparation thereof are described in British Pat. No. 870,994 published June 21, 1961 and Canadian Pat. No. 623,617 issued July 11, 1961. It is stated in those patents that it is essential that the copolymers contain at least 10 percent by weight of a lower acrylate. The presence of the lower alkyl acrylate imparts stability and serves to make the copolymer insoluble in the free acid form yet soluble in alkaline media. These acrylic copolymers are considered high molecular weight, generally having estimated viscosity average molecular weights substantially in excess of 100,000.

Examples of lower acrylates which can represent units in the copolymers include methyl, ethyl, propyl, isopropyl, n-butyl, sec-butyl, isobutyl and t-butyl acrylates. Ethyl acrylate is preferred as the acrylate unit in these copolymers. Examples of other neutral monoethylenically unsaturated copolymerizable monomers which can represent units in the copolymer are any other acrylate, any ester of methacrylic or itaconic acids, vinyl acetate, vinyl chloride, acrylonitrile, methacrylonitrile, styrene and the like. Methyl methacrylate is a preferred copolymerizable monomer.

In the aforementioned patents, it is stated that the copolymers hereinabove defined can further be modified by introducing small proportions of a polyethylenically unsaturated copolymerisable monomer, such as divinyl benzene or diallyl phthalate. For example, introducing such monomers at from 0.1 to 0.5 percent by weight, based on the total weight of monomers, results in a very low degree of cross-linking which greatly increases the molecular weight of the methacrylic acid copolymers. Such cross-linked copolymers can be employed in the present invention, although noncross-linked types are preferred.

It is to be understood that the acrylic copolymer component in a composition of the present invention may be a mixture of various copolymer materials.

The acrylic copolymers employed in the present invention can be produced by conventional aqueous emulsion polymerization techniques as described in the aforementioned patents. Aqueous dispersions containing from about 20 to about 50 percent solids by weight can be obtained by the emulsion copolymerization and such dispersions are a convenient form in which the copolymers may be employed. Such dispersions are commercially available from Rohm & Haas Company under the trademarks Acrysol® ASE-60, ASE-75, ASE-95 and ASE-108. The Acrysol® ASE-95 is preferred for use in the present invention.

The amount of Component (d) in the compositions of the present invention is from about 0.02 to about 0.05 parts by weight, per the combined parts by weight of Components (b) and (c). Surprisingly, such low amounts were found to boost the detergency of the compositions of the present invention. The full benefit of enhanced cleaning performance is not realized with amounts much lower than the above-stated lower value. On the other hand, with amounts higher than the above-stated 0.05 parts by weight, the consistency of the compositions of the present invention changes and the compositions become thickened. When certain levels are reached, the compositions turn into a gel. The compositions of the present invention employ lower amounts such that the compositions in general remain liquid, although the thicker gel forms retain most of the properties of the compositions and may be employed to prepare germicidal cleaning compositions by dissolution thereof.

The compositions of the present invention may also contain other ingredients well known in the art and typically employed in disinfectant cleaning compositions. For example, salts of ethylenediaminetetraacetic acid are often included for enhanced germicidal effectiveness of the phenolic germicide. Additionally, dyes, perfumes and color stabilizers are typically present in such compositions.

The compositions of the present invention contain water, the amount of which may vary widely from low amounts in very concentrated compositions to large amounts in end-use strength compositions. The water will be present at from about 5 to about 99 weight percent in concentrated compositions, preferably at least 50 weight percent, and in excess of 99 percent at certain end-use dilutions. Disinfectant cleaning compositions are commonly sold in an aqueous concentrated form which is diluted for end use.

The compositions of the present invention are alkaline in pH, with a preferred pH of from about 9 to about 12.0. It is desirable that the pH at end-use dilutions be from about 9 to about 10, more preferably about 9.5 to about 10. In general, the compositions at concentrated strengths have a pH higher than the corresponding composition at end-use dilution. An alkali metal hydroxide is typically employed to adjust the pH of the compositions and NaOH is preferred.

The compositions of the present invention are prepared by bringing together the various components in the desired amounts. Those skilled in the art will recognize various means for providing adequate mixtures of the ingredients present in the compositions of the present invention. Although the order of addition of ingredients may vary, it is preferred in preparing the compositions to first mix the acrylic copolymer (usually in the form of an emulsion) with a major portion of the water to be included in the composition. It is desirable to adjust the pH of the mixture of acrylic copolymer and water to about 11 to 13 to facilitate the dissolving of the acrylic copolymer in the water, and to stir until an essentially clear mixture is obtained. To this mixture, the other ingredients of the composition are then added, with the alkyl naphthalene sulfonate [Component (b)] preferably added before the ortho-benzylpara-chlorophenol.

The following Examples exemplify the present invention in further detail. These Examples are for illustrative purposes only and are not to be construed as limiting the scope of this invention. Unless otherwise stated, all parts, percentages and the like are by weight.

EXAMPLE I

Compositions A, B and C, representing concentrated disinfectant cleaning compositions, were prepared employing the ingredients listed in Table 1, in the proportions indicated therein.

TABLE 1

| PRIMARY INGREDIENTS | PARTS BY WEIGHT COMPOSITION A | COMPOSITION B | COMPOSITION C |
|---|---|---|---|
| SANTOPHEN ® 1 Solution[1] | 4.3 | 4.3 | 4.3 |
| Petro BA[2] | 10.0 | 10.0 | 10.0 |
| Bioterge AS-40[3] | — | 5.0 | 3.0 |
| Acrysol ® ASE-95[4] | 1.2 | 1.2 | 2.4 |
| Lonzaine CS[5] | 2.0 | — | — |
| Solution of Sodium Lauryl Sulfate (30% Active) | 1.0 | — | — |
| Water | 77.6 | 75.6 | 76.4 |
| OTHER INGREDIENTS | | | |
| Solution of Tetrasodium salt of Ethylenediamine-tetraacetic acid (39% Active) | 1.5 | 1.5 | 1.5 |
| Stabilizers | 0.7 | 0.7 | 0.7 |
| Dyes and Perfumes | 0.7 | 0.7 | 0.7 |
| NaOH (For pH adjustments) | 1.0 | 1.0 | 1.0 |
| | 100.0 | 100.0 | 100.0 |

[1]A 72 percent by weight solution of ortho-benzyl-para-chlorophenol germicide in isopropanol sold by Monsanto Company.
[2]An aqueous solution containing 50 percent by weight linear alkyl naphthalene sodium sulfonate sold by Petro Chemical Co., Inc.
[3]An aqueous solution a α-olefin sulfonate sold by Stepan Chemical Co. (39 percent active).
[4]An acrylic copolymer emulsion (20 percent solids sold by Rohm & Haas Co.
[5]An aqueous solution containing 50 percent N-cocoamidopropyl-N,N-dimethyl-N-2-hydroxypropyl sulfo-betaine sold by Lonza, Inc.

The Acrysol ® ASE-95 was first mixed with approximately 90 percent (70 parts) of the water employed and the pH of this mixture was adjusted to 12 with sodium hydroxide. This mixture was stirred until clear and then, in the following order were added the Petro BA, EDTA, stabilizers and SANTOPHEN ®1. Sodium sulfite was employed as a stabilizer. The mixture was continuously stirred during the addition of the materials. The pH of the mixture was then adjusted to 11.5 using sodium hydroxide and then the surfactant(s) (Bioterge AS-40, Lonzaine CS, sodium lauryl sulfate), dyes and perfumes were added and the mixture stirred well.

The resulting compositions were essentially clear. The pH of Composition A was 11.5, Composition B was 11.5 and Composition C was 11.6.

Various properties desirable for disinfectant compositions are demonstrated for Compositions A, B and C, in the following Example II.

EXAMPLE II

(A) Cleaning Performance

The cleaning performance of Compositions A, B and C were evaluated employing a modified version of the method for evaluating hard-surface cleaners described by R. L. Liss and T. B. Hilton in SOAP AND CHEMICAL SPECIALTIES, August, 1960. In accordance with that procedure, a soil mixture containing oils, solvents and iron oxide (metallic brown) was prepared. A 4 gram sample of this soil mixture was then applied to a strip of white vinyl wallpaper (5.1×30.5 centimeters) and spread to a thickness of about 0.005 centimeters using a "doctor" blade. The soiled wallpaper was then placed in a constant temperature and humidity room (22° C., 50 percent relative humidity) and left overnight to dry.

The wallpaper was then washed in accordance with the aforementioned published procedure except that the cleaning solution employed consisted of 1 part of Composition A, B or C, as the case may be, diluted with 64 parts of water. Standards were also run which consisted of carrying out the identical washing procedure under the same conditions, substituting commercial hard-surface cleaning compositions for the Compositions A, B or C. For Compositions A and B multiple runs were made.

In accordance with the published procedure, cleaning efficiency was determined employing reflectance measurements made with a Gardner Color Difference Meter (Gardner Laboratory, Inc.). The percent cleaning efficiency (percent C.E.) is calculated according to the formula:

$$\% \ C.E. = \frac{R_2}{R_1} \times 100$$

wherein $R_1$ equals the reflectance of unsoiled, unwashed wallpaper and $R_2$ equals the reflectance of soiled, washed wallpaper. The percent comparative cleaning efficiency is then calculated as follows:

$$\frac{\% \ C.E. \text{ Test Sample}}{\% \ C.E. \text{ Standard}} \times 100.$$

The results of the cleaning performance evaluation by the just-described procedure are shown in Table 2. The materials employed as standards were commercial hard-surface cleaning compositions, with Standard A containing phosphates and Standard B being phosphate-free.

TABLE 2

| Comparative Cleaning Efficiency | | | |
|---|---|---|---|
| Composition | | Standard A | Standard B |
| A. | Run 1 | 80% | 231% |
| | Run 2 | 72% | 160% |
| | Run 3 | 81% | 178% |
| | Run 4 | 79% | 129% |
| B. | Run 1 | 63% | 146% |
| | Run 2 | 66% | 182% |
| | Run 3 | 57% | 127% |
| | Run 4 | 46% | 111% |
| C. | Run 1 | 75% | 180% |

(B) Storage Stability

The storage stability of Compositions A, B and C under various temperature conditions was determined. Samples of the compositions were stored at various temperatures for certain time periods after which a visual check for clarity and change in appearance of the samples was made. In addition, a "freeze/thaw" test was run on the compositions. This test consisted of one or more cycles of freezing and thawing of a sample with a visual check for clarity and change in appearance of the sample after each cycle. In the case of Compositions A and B, the "freeze/thaw" test was run in duplicate, with one run including an inversion of the sample between cycles.

In the stability tests it is desirable that there be no substantial phase separation or precipitation of ingredients in the solution. A solution which remains clear is considered to exhibit outstanding stability.

The results of the storage stability testing are presented in Table 3.

TABLE 3

| STORAGE CONDITION | STORAGE STABILITY COMPOSITION A | COMPOSITION B | COMPOSITION C |
|---|---|---|---|
| Room Temperature (24° C.) | | | |
| - Overnight | clear-no change | clear-no change | clear-no change |
| - 4 Weeks | clear-no change | clear-no change | — |
| Refrigerator (3° C.) | | | |
| - Overnight | clear-no change | clear-no change | clear-no change |
| - 4 Weeks | clear-no change | clear-no change | — |
| Oven (43° C.) | | | |
| - Overnight | clear-no change | clear-no change | clear-no change |
| - 4 Weeks | clear-no change | clear-no change | — |
| Freeze/Thaw Test | | | |
| 1 cycle-no inversion | white cloudy layer on top 5%, disappears on inversion | clear-no change | clear-no change |
| 4 cycles-no inversion | white cloudy layer on top, not fully dispersed after 5 days | white cloudy layer on top, disappeared within 5 days | — |
| 4 cycles-inversion between cycles | white cloudy layer on top 20%, disappears on inversion | clear-no change | — |

(C) Germicidal Effectiveness

The germicidal effectiveness of Compositions A and B against the organisms *Staphylococcus aureus* and *Salmonella chloreasuis* was determined according to the method described in "Official Methods of Analysis of the Association of Official Analytical Chemists" (AOAC), 12th Edition (1975), paragraph 4.007-0.011, pages 59–60. The evaluation was performed on a use dilution of 1 part of Composition A or B diluted with 64 parts of water. The culture medium was letheen broth. Exposure was for 10 minutes and incubation was for 48 hours at 37° C. For each organism, 60 carriers were exposed.

The results of the germicidal testing for Composition A and B showed 0 growth in the 60 carriers in the case of the *Salmonella choleraesuis* and 1 growth in the 60 carriers for the case of *Staphylococcus aerus.* Composition C would be expected to be as effective as Compositions A and B in germicidal activity.

The above Examples I and II clearly demonstrate effective disinfectant cleaning compositions within the present invention. In view of the disclosure herein, various other compositions within the present invention would be apparent to those skilled in the art.

What is claimed is:

1. An aqueous composition comprising:

(a) from about 0.03 percent to about 20 percent by weight ortho-benzyl-parachlorophenol;

(b) from about 1.0 to about 2.4 parts by weight, per part by weight of Component (a), of an alkali metal salt of an alkyl naphthalene sulfonic acid, or mixtures thereof;

(c) from 0 to about 1.5 parts by weight, per part by weight of Component (a), of a surfactant which is different from Component (b) selected from the group consisting of water soluble organic sulfonates, sulfobetaine surfactants, and mixtures thereof; and (d) from about 0.02 to about 0.05 parts by weight, per combined parts by weight of Components (b) and (c), of a detergency boosting acrylic copolymer.

2. A composition in accordance with claim 1 wherein the alkyl naphthalene sulfonic acid of Component (b) contains from 1 to about 3 alkyl groups with the total number of carbon atoms for said groups being a maximum of about 9.

3. A composition in accordance with claim 1 wherein Component (c) is present at from about 0.3 to about 1.5 parts by weight, per part by weight of Component (a).

4. A composition in accordance with claim 3 wherein the water soluble organic sulfonates of Component (c) are selected from the group consisting of sodium or potassium salts of alkylbenzene sulfonates, and α-olefin sulfonates.

5. A composition in accordance with claim 3 wherein the water soluble organic sulfonate of Component (c) is a sodium or potassium salt of an α-olefin sulfonate.

6. A composition in accordance with claim 3 wherein Component (c) contains a sulfobetaine surfactant.

7. A composition in accordance with claim 6 wherein the sulfobetaine surfactant is a 3-(N,N-dimethyl-N-acylamidopropylammonio)-2-hydroxypropane-1-sulfonate wherein the acyl group is derived from tallow fatty alcohol or coconut fatty alcohol.

8. A composition in accordance with claim 1, 2, 3, 4, 5, 6, or 7 wherein Component (a) is present at from about 0.05 percent to about 5 percent by weight.

* * * * *